US009206709B2

(12) United States Patent
Christidis et al.

(10) Patent No.: US 9,206,709 B2
(45) Date of Patent: Dec. 8, 2015

(54) METHOD FOR THE INSTALLATION CONTROL IN A POWER PLANT

(75) Inventors: Andreas Christidis, Berlin (DE); Klaus Wendelberger, St. Leon-Rot (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 1392 days.

(21) Appl. No.: 12/999,088

(22) PCT Filed: May 28, 2009

(86) PCT No.: PCT/EP2009/056529

§ 371 (c)(1),
(2), (4) Date: Mar. 17, 2011

(87) PCT Pub. No.: WO2010/003735

PCT Pub. Date: Jan. 14, 2010

(65) Prior Publication Data

US 2011/0160926 A1 Jun. 30, 2011

(30) Foreign Application Priority Data

Jun. 16, 2008 (DE) ..... 10 2008 028 527

(51) Int. Cl.
*F01K 13/02* (2006.01)

(52) U.S. Cl.
CPC ..... *F01K 13/02* (2013.01)

(58) Field of Classification Search
CPC ..... G05B 17/02; G05B 13/022; G05B 13/04; G05B 13/041; G05B 13/042; G05B 13/047; G05B 13/048; G05B 15/02; F01K 13/02
See application file for complete search history.

(56) References Cited

U.S. PATENT DOCUMENTS

| | | | | |
|---|---|---|---|---|
| 4,868,754 | A | 9/1989 | Matsumoto | |
| 7,110,835 | B2 * | 9/2006 | Blevins et al. | 700/83 |
| 2006/0200325 | A1 | 9/2006 | Hayashi | |
| 2007/0168057 | A1 * | 7/2007 | Blevins et al. | 700/53 |
| 2007/0240648 | A1 | 10/2007 | Badami | |
| 2008/0188960 | A1 * | 8/2008 | Nixon et al. | 700/86 |

* cited by examiner

*Primary Examiner* — Mohammad Ali
*Assistant Examiner* — Nathan L Laughlin

(57) ABSTRACT

A method for the installation control in a power plant is provided. A functional value of a target function based on a physical model is generated for a plurality of sets of variables, from respectively a set of environment variable and the respective set of variables, the functional value is allocated to the respective sets. The set of variables is selected to be transmitted to a control device of the power plant, whose allocated functional value complies with a predefined optimization criterion. In addition to a starting set and a set determined on the basis of the starting set and the functional value allocated thereto using a gradient method, the number of sets of variables further includes a set selected by a random generator. In addition, a control apparatus for a power plant using the method and a power plant using the control apparatus are provided.

16 Claims, 1 Drawing Sheet

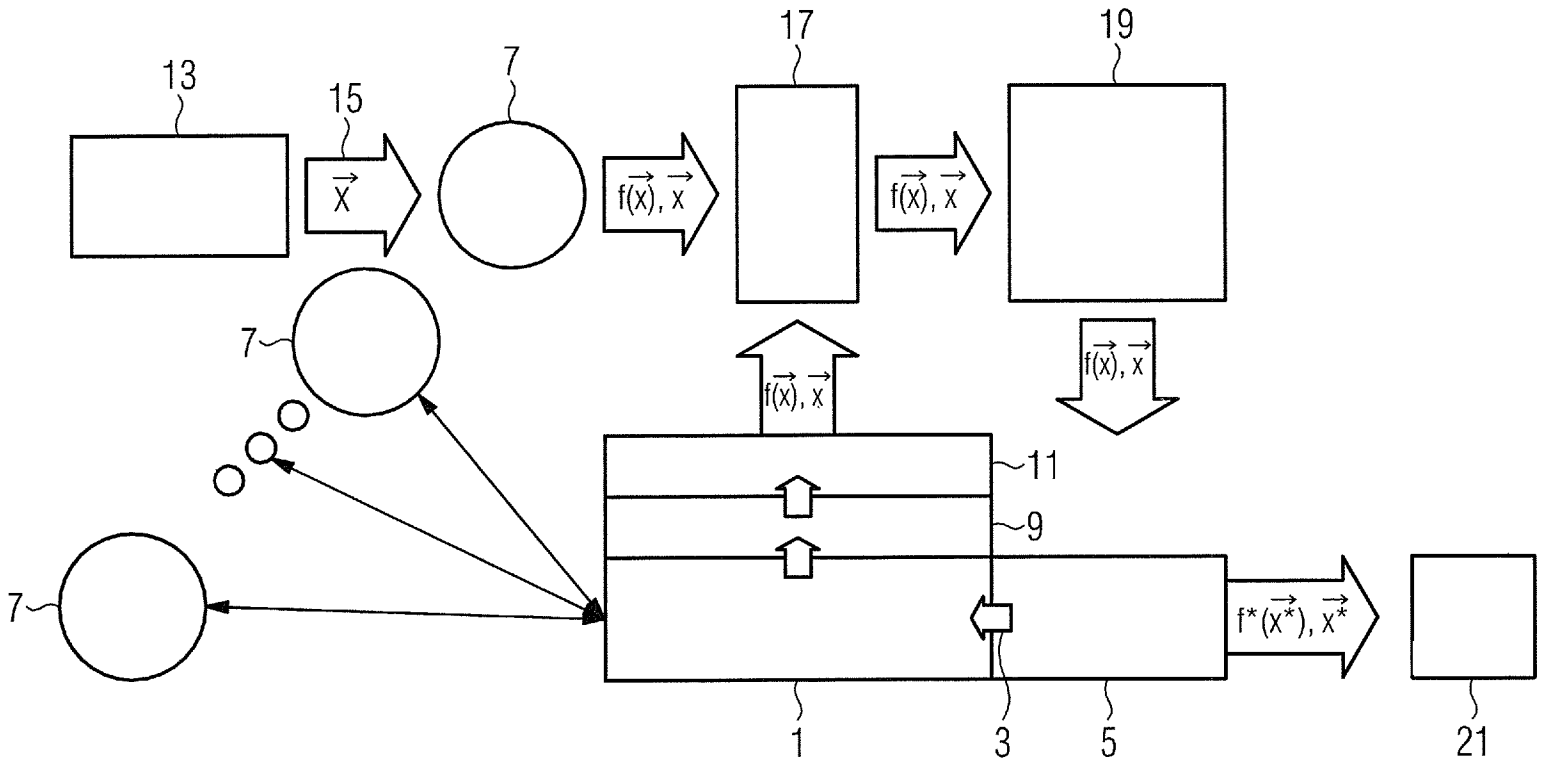
13
15
$\vec{x}$
7
$\vec{f}(\vec{x}), \vec{x}$
17
$\vec{f}(\vec{x}), \vec{x}$
19
$\vec{f}(\vec{x}), \vec{x}$
7
7
11
9
3
1
5
$\vec{f}^*(\vec{x}^*), \vec{x}^*$
21

METHOD FOR THE INSTALLATION CONTROL IN A POWER PLANT

CROSS REFERENCE TO RELATED APPLICATIONS

This application is the US National Stage of International Application No. PCT/EP2009/056529, filed May 28, 2009 and claims the benefit thereof. The International Application claims the benefits of German application No. 10 2008 028 527.7 DE filed Jun. 16, 2008. All of the applications are incorporated by reference herein in their entirety.

FIELD OF INVENTION

The invention relates to a method for the installation control in a power plant, wherein a functional value of a target function based on a physical model is generated for a plurality of sets of variables from respectively a set of environment variables on the one hand and the respective set of variables on the other hand, said functional value being allocated to the respective sets, wherein the set of variables is selected to be transmitted to a control device of the power plant whose allocated functional value complies with a predefined optimization criterion.

BACKGROUND OF INVENTION

In a power plant, non-electrical energy, for example in the form of fossil fuels, is converted into electrical energy and a power network is provided. Depending on the type of raw material used for the generation of electrical energy, a differentiation is made for example between coal-fired power plants, nuclear power plants, gas and steam turbine power plants etc.

Due to the internationally increasing demand for energy and the shortage of fossil fuel primary energy sources, the price of the major raw fuels used for conversion into electricity is currently rising. In addition, there are increasingly strict environmental requirements relating to fine dust, $NO_x$, $SO_2$ and $CO_2$. Therefore, attempts are being made to increase the efficiency of power plants, i.e. improve their operational performance.

In addition to cost-intensive development and the renewal of plant components, modern process control technology can also help to optimize process management taking into account the current boundary conditions. Here, different optimization criteria may be required, such as, for example, increased efficiency or reduced pollutant emissions. In this regard, decisions which were traditionally based on the experience of the operating personnel can nowadays be reached with the aid of computers and corresponding methods based on physical mathematical models of the plant power process.

Usually, a method of this kind includes a target function which uses a physical model of the power plant in question to generate a scalar or vector-valued function value, for example, from a set of process values. Hereby, the process values include, on the one hand, values determined by external influences (environment variables) such as, for example, ambient and cooling-water temperature, and which change during operation. Therefore, these environment variables represent current boundary conditions which cannot be influenced, but which do exert an influence on the process.

On the other hand, the process values also include manipulated variables such as, for example, the position of an actuator or valve or the quantity of fuel supplied, which can be influenced by the operating personnel or an automated control device during the operation of the power plant, i.e. process or state variables that are freely selectable within certain limits. Each set of variables in conjunction with the environment variables produces a target function value which can be used to evaluate the relevant set and it is usual to select the set of variables for transmission to a control device of the power plant whose assigned functional value complies with a predefined optimization criterion. In the case of a scalar function value, this can be, for example, the highest or smallest functional value.

In order to find an optimum set of variables for controlling the power plant, it is usual to use gradient methods to find a minimum or maximum for the target function. Various methods are known for this, for example, the method of steepest descent, the (quasi-)Newton method, sequential quadratic programming or the simplex algorithm. Common to all gradient methods is that a local maximum or minimum of the target function is found on the basis of a starting value.

Physical models of power plants, from which the target function for optimization is obtained, are generally not linear and generally not convex. Depending upon the selected starting value, therefore, under some circumstances, the gradient method can find a local maximum or minimum, i.e. locally optimized power plant operating conditions, but this does not guarantee that globally optimum operating conditions have also been found at the same time.

SUMMARY OF INVENTION

Therefore, the object underlying the invention is to disclose a method for installation control in a power plant and a control apparatus for a power plant, which, with the lowest possible technical complexity, allows improved operation of the power plant with respect to a provided optimization criterion such as, for example, improved efficiency or a reduction of emissions.

With respect to the method, this object is achieved according to the invention in that, in addition to a starting set and a set determined on the basis of the starting set and the functional value allocated thereto by means of a gradient method, the number of sets of variables further comprises a set selected by a random generator.

Hereby, the invention is based on the consideration that improved operation of the power plant would be possible if, when determining the variables of the power plant with respect to the given optimization criterion such as improved efficiency and/or reduced emissions, it were also possible to find a globally optimized set of variables. This could happen, for example with a Monte-Carlo method, which selects random-based variables and compares their functional values and optionally, in a further step, checks a further number of randomly selected variables in the range of the best set of variables. However, a method of this kind is comparatively time-consuming and compute-bound and therefore also requires comparatively complex computer technology. Therefore, the comparatively faster gradient methods should in principle be retained, but extended in the form of a hybrid structure by a random-based system to enable the determination of a global optimum of variables. This can be achieved in that additionally a set of variables determined by means of a random generator and its allocated functional value of the target function is introduced during the gradient method and this random set of variables is included in the comparison of the sets of variables and their respective functional values.

Combining a gradient-based method with a random model, on the one hand, guarantees that a global optimum for the variables for the installation control will be found and, on the other, ensures comparatively fast convergence of the optimization algorithm to suitable variables. Therefore, an algorithm configured in this manner is also suitable for online optimization in the power plant process, i.e. for the adaptation of the variables to the respective optimum operating conditions during the operation of the power plant. To this end, the method is advantageously performed with cyclic repetition in the form of a loop, wherein the selected set of variables of a cycle is the starting set of the cycle following this cycle. This means that, once it has been selected and found, a set of variables can also be further improved even during the operation of the power plant and a continual search for global optima is performed.

This is of particular benefit with respect to the environment parameters which change during operation. Namely, if, for example, an environment parameter such as, for example, the cooling-water temperature changes, the selected set of variables can, in some circumstances, no longer be the optimum set of variables. In this case, the set of variables is changed to such a degree by means of the continuously executed gradient method that a new optimum is again set with respect to the selected optimization criteria. Due to the complex relationship between the environment variables and the functional value of the target function, however, a change in the environment variables can also result in a new global optimum which would not be found with a pure gradient method, since this would remain in the local optimum. Combining the random-based system with the gradient method in a cyclic design enables a new global optimum to be found during operation. This new optimum is then transmitted to a control device of the power plant and there it can be displayed to the operating personnel, thus enabling rapid reaction and hence particularly efficient operation of the power plant.

Online optimization in the installation control in a power plant enables, at any time during the operation, the determination of an optimum set of variables to guarantee particularly efficient operation of the power plant. In order to enable this set of variables to reach the installation control in the power plant as quickly as possible, the selected set of variables is advantageously transferred in the control device to the respective control devices of the power plant allocated to the individual variables. Direct transmission of the variables to the relevant control devices such as, for example, the fuel transfer device, achieves particularly fast, automatic optimization of the power plant operation. Intervention on the part of operating personnel is no longer necessary so that, on the one hand, automatic operation of the power plant is guaranteed and, on the other, the transmission of the optimal variables to the control devices takes place particularly quickly.

In addition to the external influences resulting from the environment variables, the operation of a power plant is also subject to further restrictions which must be considered during control and optimization. In the simplest case, restrictions of this kind can be limits on individual variables, such as, for example, the cooling-water mass flow or more complex relationships. These can be expressed in the physical model for example by equations or inequalities in which a plurality of variables occur in combination. In order to take restrictions of this kind into account appropriately in the optimization and installation control, the target function advantageously comprises a penalty function. A penalty function of this kind is designed to supply the value zero as long as the restrictions are not infringed and contains a monotonically increasing relationship between the error from the infringement of the restriction and its functional value. In this way, the addition of the target and penalty functions produces a modification of the target function with which the optimization is performed. This enforced degradation of the target function values in the impermissible range means the method supplies a set of variables with which the restrictions are not infringed. In addition, this enables the method to commence the gradient method and hence the optimization even with an impermissible starting value, which is not always the case with other methods for incorporating restrictions. This enables a further simplification of the method.

When determining a set of variables by means of the gradient method, the gradient serves as an indicator of the direction in which the respective variables have to be changed in order to arrive at an optimum set of variables. However, it is questionable how far the variables have to be changed, i.e. which increment should be used when using the gradient method. This can take place, for example, in that, in each iteration, a one-dimensional optimization is performed along the search direction and hence an apparently optimum increment is found. However, this has the result that the search direction is in each case orthogonal to the previous one, since the partial derivative at the current position after the previous search direction was minimized to the value zero by the one-dimensional optimization in the preceding iteration. With narrow valleys of the target function, this effect leads to a zigzag pattern with very small increments and hence to numerous iterations. Since, however, it is precisely in the case of online optimization that rapid convergence should be attempted, since the sets of variables should be employed immediately in the power plant, advantageously, prior to the respective determination of the set by means of the gradient method, an increment is predefined. A predefined increment enables the gradient method to be performed quickly and should be kept constant until an iteration (in the case of minimization) supplies a higher functional value than the previous one. The increment is then reduced and the method continued from the best value. This permits a particularly rapid performance of the method and particularly efficient online optimization of the power plant operation.

With respect to the control apparatus, the object is achieved by a control apparatus for a power plant with a random generator module and a gradient module, which is connected on the data output side to a comparison module, wherein the control apparatus is designed for the performance of the named method. Advantageously, a control apparatus of this kind in a power plant is used with a control device and a control apparatus of this kind connected to the control device on the data input side.

The advantages obtained with the invention consist in particular in that the additional consideration of a set of variables selected by means of a random generator means the possibility of finding a global solution by means of the random generator is combined with the speed of the gradient method. The random generator generates potential starting values for the gradient method, which are accepted, for as long as, in the sense of the physical model of the target function, they are better than the local optimum found so far by the gradient method. Due to the cyclic use of the method and the use of current environment variables, which can be taken directly from the process control system, the method has an online capability. If the plant's operating conditions change, this information is entered into the physical process model online and the optimization algorithm finds the new optimum quickly. Hereby, in the process control technology of a power plant, the method can initially serve as an aid to the operating personnel, but for rapid reaction of power plant control technology, can also be switched directly to corresponding actuators for automatic transmission. This enables particularly efficient operation of a power plant with low technical complexity.

BRIEF DESCRIPTION OF THE DRAWINGS

An exemplary embodiment of the invention will be explained in more detail with reference to a drawing. The diagram is a schematic representation of the method for installation control in a power plant.

DETAILED DESCRIPTION OF INVENTION

The method shown in the diagram optimizes with cyclic repetition the variables for the power plant in order to achieve particularly efficient operation of the power plant. The cyclic repetition means the method can be used online, i.e. it can be integrated directly in the process control technology and determine the instantaneous optimum variables during operation. One possible field of application is, for example, the optimization of the interval between the soot blowing processes in the power plant boiler and their duration and the cleaning intervals for the filters for flue gas cleaning, where a balance is struck between short-term under-function and a long-term increase in efficiency. Two further optimization problems relating to power plants are the determination of the optimum cooling-water mass flow, where this can be controlled, and process management during combustion with observance of emission limits and plant-induced restrictions.

The diagram depicts the method as a block diagram. The gradient module 1 is provided with starting values 3 from a storage module 5, from which, in a number of steps or iterations the closest optimum is found with the aid of numerical differentiation. The basis for this optimization is the functional values determined for each set of variables and environment variables with reference to a target function 7 based on a physical model.

Hereby, restrictions on the variables are incorporated additively in the target function 7 by a penalty function. As long as the restrictions are observed, the penalty function supplies the value zero so that no modification of the target function 7 takes place. If the restrictions are infringed, the penalty function supplies a value higher (lower) than zero if this entails a minimization problem (maximization problem). A constantly rising (falling) relationship between the error resulting from infringement of the restrictions and the functional value of the penalty function causes the optimization method, which works with the target function 7 modified by the penalty function, to be automatically steered in the direction of the valid range, provided that the penalty function has a quantitatively greater ascent than the target function. To ensure this, a steeply ascending penalty function is used, which means an optimum of the unmodified target function only becomes the optimum of the target function 7 under active consideration of the restrictions within the required accuracy.

In the gradient module 1, a plurality of iterations of the gradient method can be performed so that a particularly precise set of variables of a local optimum can be found here. The set of variables found in this way is transmitted together with the respective allocated functional values of the target function 7 to a comparison storage module 9. This compares the current functional value with the (in the sense of the target function 7) best value so far and, in each cycle, switches the set with the lower (higher) functional value through to the storage module 11, as long as minimization (maximization) is concerned.

The gradient method enables a local optimum of variables for the operation of the power plant to be found. However, in particular with a change to the environment variables, which cannot be influenced by the operating personnel, in some circumstances, there may be another global optimum which cannot be found using the gradient method. In order also to ensure particularly efficient operation of the power plant in such a case, a random generator module 13 is provided, which in every cycle for every variable 15 generates approximately equally distributed random values within its definition range. The randomly generated set of variables 15 is evaluated via the target function 7 and fed together with the functional value of the target function 7 as a first input set to the comparison module 17, which receives the set determined by the gradient method from the comparison storage module 11 as the second input set. The comparison module 17 compares the functional values of the two input sets and, in each computing cycle, switches the input set through to the output with the lower (higher) functional value, if minimization (maximization) is intended.

In an extension of the system for treating a larger number of variables 15, it is also possible to consider the inclusion of a second or further random generator modules 13. This enables the optimization domain, which increases exponentially with the number of variables 15, to be searched with more stochastic intensity and accelerates the determination of the global optimum.

The output of the comparison module 17 is connected to a comparison storage module 19, which, in the time window in which the gradient method runs, stores the lowest or highest functional value with the associated variables from the comparison module 17. If the gradient method converges, the stored set is transferred to the storage module 5 and from there to the control device 21 of the power plant, wherein the storage module 5 is upstream of the gradient module 1 and supplies its starting values 3. Simultaneously, the newly found optimum, which in the comparison storage module 9 is downstream of the gradient module 1, is transmitted to the storage module 11 before the comparison module 17 and, in the next cycle, the comparison storage modules 9, 19 are reset.

This setup causes a found optimum to be held unchanged in the loop until either a better variable set from the stochastic part replaces the result of the last cycle of the gradient method or a change to the environment variables has brought about a displacement of the position of the optimum.

The following describes the individual modules of the method in more detail.

The random generator module 13 has eight analog inputs for specifying the upper ($ULx_i$) and lower ($LLx_i$) limit for each variable 15 (here: 4). In each computing cycle, a set of random variables $x_i$ (i=1, 2, 3, 4) is generated, these variables are applied to the four outputs, wherein each individual variable is approximately equally distributed within its definition range. This is to ensure that the entire definition range of the variables is covered and hence the global optimization is successful.

The random generator of each individual variable is based on the linear congruence generator and is a pseudorandom generator, since on each start, the same random number sequence is output. Therefore, like many random generators, the linear congruence generator also works with the modulo function, which outputs the remainder of a division. The recursive formation specification for the random numbers $y_i^t \in [0, 1]$ and the random variables $x_i^t \in [U\ Lx_i, LLx_i]$ describe the equations 1 and 2. Table 1 lists the parameters which were used for the four random generators in the module described:

$$y_i^{t+1}=((ay_i^t+b)\bmod m)\bmod 1 \quad (1)$$

$$x_i^t=(U\,Lx_i-LLx_i)y_i^t+LLx_i \quad (2)$$

TABLE 1

Parameters used in the random generator module 17

| | a | b | m |
|---|---|---|---|
| Variable 1 | 3.141592653589793 | 2.718281828459045 | 3 |
| Variable 2 | 3.141592653589793 | 1.526341538658045 | 2 |
| Variable 3 | 2.718281828459045 | 3.141592653589793 | 3 |
| Variable 4 | 2.718281828459045 | 2.268542658582743 | 2 |

For the implementation of the modulo function, the rounded-down value is subtracted from the result of the division to obtain the remainder. The rounding down is performed by a case distinction according to the following logic:

$Z_0=0$ if number>1 and number<2

$Z_1=1$ if number>2 and number<3

$Z_2=2$ (etc)

$$\text{rounded-down number}=\sum_i z_i$$

With this method, the parameters a, b and m must be selected so that all possible results correspond to a case in the case distinction in order to obtain an approximately equally distributed sequence of numbers.

The comparison module 17 has analog input sets $f(\vec{x})_1$, $\vec{x}_1$ and $f(\vec{x})_2$, $\vec{x}_2$ (and optionally $f(\vec{x})_3$, $\vec{x}_3$ and a set of analog outputs $f(\vec{x})$, $\vec{x}$. The binary input 1 = max 0 = min serves to define the minimization or maximization (1=maximization, 0=minimization) depending on the target function. Switched through in each case (in each cycle) is the input set $f(\vec{x})_j$, $\vec{x}_j$ with which $f(\vec{x})_j$ is highest when the binary input is true (1) or lowest when the binary input is false (0).

The third input is normally masked out and not connected, which causes the value zero to be applied. To prevent this leading to a malfunction of the comparison module 17, when the value zero is applied, internally at all inputs this is replaced by the lowest (maximization) or highest (minimization) displayable value so that the desired filtration functions are retained. This must be observed in particular if the desired optimum is zero, since this will consequently not be taken into account.

The storage module 5, 11 has an analog input set $f(\vec{x})$ and $\vec{x}$, a binary input SET and an analog output set $f(\vec{x})$ and $\vec{x}$. When SET is set to 1, the value set at the input is switched through to the output, when SET is reset to 0 to it is stored and applied to the output until the input SET is set back to 1.

The comparison storage module 9, 19 has an analog input set $f(\vec{x})$ and $\vec{x}$, a binary input 1 = max 0 = min for defining the type of optimization, a binary input SET, a binary input RS (RESET) and a set of analog outputs $f(\vec{x})$ and $\vec{x}$. While SET and RESET are false, the set of values $f(\vec{x})$ and $\vec{x}$ is stored and output at the output which previously had the highest (maximization) or lowest (minimization) value depending upon the type of optimization. If SET is set to 1, the input set $f(\vec{x})$ and $\vec{x}$ is switched through to the output set $f(\vec{x})$ and $\vec{x}$ and stored when SET is reset to 0, as with storage module 5. This set remains stored until a set with a higher or lower $f(\vec{x})$ is applied to the input and replaces the set currently stored by the "SET" command. The binary "RESET" input sets the memory to the smallest $$\left(\begin{matrix}1=\max\\0=\min\end{matrix}=1\right)$$

or highest $$\left(\begin{matrix}1=\max\\0=\min\end{matrix}=0\right)$$

value displayable. This input is required for the initialization and when the algorithm is started has to be actuated once with a pulse. Without this measure, the initial value of the memory would be zero and it would not store any new values (e.g. with a maximization with a target function with which all functional values are negative).

The gradient module 1 has for each variable $x_1$ (here: 4) three analog inputs for specifying the upper ($U\,Lx_1$) and lower ($LLx_1$) limit and the starting value $x_{is}$. There is also an analog input $f(\vec{x})$ and, for each variable $x_i$, an analog input $f(\vec{x}+\vec{e}_i\Delta x_i)$. Finally, the module has two further binary inputs 1 = max 0 = min and RS and four analog inputs "steps", "minstep", "1/Dx" and "cycle time". As described above, the type of optimization is specified via the input 1 = max 0 = min and the computing cycle time with which the optimization algorithm is to be executed should be specified in seconds at the input "cycle time". The interval between the support point for the formation of the difference quotients and "steps" and "minstep" enter the increment control via 1/Dx as described below. The outputs consist of a binary signal "Cony", which is true when the gradient method is converged, and two analog outputs $x_i$ and $x_i+\Delta x_i$ for each variable.

As the name implies, the gradient method forms the partial derivatives of the target function according the variables in order to determine the optimization direction. To this end, on the basis of the position vector $\vec{x}^1$, which in the first iteration is the starting value vector $\vec{x}_s$, support points are formed which are each displaced by $$\frac{U\,Lx_i - LLx_i}{1/Dx}$$

in the direction of a variable $x_i$. The evaluation of the target function at the support points and formation of the discretized partial derivatives reveals the search direction. The standardized search direction is achieved by dividing the search direction vector (gradient) by the amount of the highest partial derivative so that the standardized main search direction component has the value one. The initial increment is formed from the definition range ($U\,Lx_i-LLx_i$) of the variables with the highest partial derivative in that this is multiplied by $$\frac{steps^{1,5}}{\text{min step}}.$$

The new vector $\vec{x}^{t+1}$ results from the previous one together with the standardized search direction extended via the increment. This method is repeated until the value of the target function does not constantly change, but oscillates. If the numerically formed gradients have changed their sign three time in a row, the value "steps" is reduced internally by one and the method continues with a reduced increment. The convergence criterion is complied with if the increment has achieved the value zero or if the value of the target function does not change within four iterations. In this case, the binary output "Cony" is true and the gradient method can be restarted by actuating the "RS" input and new starting values.

The inclusion of the limits of each individual variable 15 enables the optimization problem to be scaled. In this way, account is taken in the first instance of the requirement for a specific accuracy of the solution relative to the definition range of the variables 15. For example, the smallest increment in the main search direction can be specified shortly before convergence via "min-step". This is $$\frac{1}{(\text{min step})}$$

of the definition range of the variables 15 with the highest partial derivative in the immediate vicinity of the optimum. This enables the required accuracy of the solution to be set. The initial increment, which, based on the definition range of the variables 15 with the instantaneous highest partial derivative, is "steps$^{1,5}$" higher that the final increment, is defined via the parameter "steps". This simple, heuristic incremental control enables the speed of convergence to be significantly accelerated.

Provided for the incorporation of the penalty functions are a binary input

1 = max

0 = min for specifying the type of optimization, two analog inputs e and $f(\vec{x})$ and an analog output $f(\vec{x})+p(e)$. Here, e is the error caused by the infringement of the restrictions and $f(\vec{x})$ the value of the target function 7. The penalty term p(e) is formed from the error and added to the target function 7 in the case of a minimization or subtracted from the target function in the case of a maximization. The penalty function p(e) is described in equation 3:

$$p(e) = \left(\exp(\sqrt{|e|}) + \sqrt{\frac{|e|}{10}} - 1\right)\cdot 1000 \tag{3}$$

The restrictions in the form $g(\vec{x})_1$ g<0 and $g(\vec{x})_2>0$ are linked to the following pseudocode:

if $g(\vec{x})_1<0$
$e_1=0$
otherwise
$e_1=g(\vec{x})_1$
if $g(\vec{x})_2>0$
$e_2=0$
otherwise
$e_2=g(\vec{x})_2$ 1
$e=e_1+e_2$ In the rare event of a restriction in the form of an equation $h(\vec{x})=0$, this can be described by two inequalities $h(\vec{x})=0$ and $h(\vec{x})_2>0$.

A method for installation control in a power plant in the embodiment described above satisfies the requirements for integrated use in the process control technology and enables a global optimum set of variables 15 to be found quickly. Hence, this enables permits particularly efficient operation of the power plant with a high efficiency and/or particularly low pollutant emission.

The invention claimed is:

1. A method for the installation control in a power plant, comprising:

generating a functional value of a target function based on a physical model for a plurality of sets of variables from respectively a set of environment variables and the respective set of variables, wherein the target function comprises a steeply ascending penalty function;

wherein the penalty function has a quantitatively greater ascent than the target function;

optimizing an unmodified target function under active consideration of the penalty function, allocating the functional value to the respective sets; and transmitting a selected set of variables to a control device of the power plant wherein the allocated functional value complies with a predefined optimization criterion, wherein in addition to a starting set and a first set determined on the basis of the starting set and the functional value allocated thereto using a gradient method, a number of the plurality of sets of variables further comprises a second set selected by a random generator.

2. The method as claimed in claim 1, wherein the method is performed with cyclic repetition in a form of a loop, and wherein the selected set of variables of a first cycle is a starting set of a second cycle which follows the first cycle.

3. The method as claimed in claim 1, wherein the selected set of variables is forwarded from the control device to the respective control devices of the power plant allocated to the individual variables.

4. The method as claimed in claim 1, wherein the penalty function supplies the value of zero when a plurality of restrictions are not infringed.

5. The method as claimed in claim 1, wherein the penalty function supplies a value greater than zero when a plurality of restrictions are infringed.

6. The method as claimed in claim 1, wherein before the determination in each case of the first set using the gradient method, an increment is predefined.

7. A control apparatus for a power plant, comprising:

a control device;

a storage module;

a random generator module;

a gradient module; and a comparison module, wherein the random generator module and the gradient module are connected on a data output side to the comparison module, wherein the comparison module compares the output from the random generator module and the gradient module and sends a comparison to the storage module, and wherein the control apparatus is designed to perform a method for the installation control in a power plant, comprising:

generating a functional value of a target function based on a physical model for a plurality of sets of variables from respectively a set of environment variables and the respective set of variables, wherein the target function comprises a steeply ascending penalty function, wherein the penalty function has a quantitatively greater ascent than the target function;

optimizing an unmodified target function under active consideration of the penalty function, comparing the plurality of sets of variables and their respective functional values, allocating the functional value to the respective sets, and transmitting a selected set of variables from the storage module to the control device of the power plant wherein the allocated functional value complies with a predefined optimization criterion, wherein in addition to a starting set and a first set determined on the basis of the starting set and the functional value allocated thereto using a gradient method, a number of the plurality of sets of variables further comprises a second set selected by a random generator.

8. The control apparatus as claimed in claim 7, wherein the method is performed with cyclic repetition in a form of a loop, and wherein the selected set of variables of a first cycle is a starting set of a second cycle which follows the first cycle.

9. The control apparatus as claimed in claim 7, wherein the selected set of variables is forwarded from the control device to the respective control devices of the power plant allocated to the individual variables.

10. The control apparatus as claimed in claim 7, wherein the penalty function supplies the value of zero when a plurality of restrictions are not infringed.

11. The control apparatus as claimed in claim 7, wherein the penalty function supplies a value greater than zero when a plurality of restrictions are infringed.

12. The control apparatus as claimed in claim 7, wherein before the determination in each case of the set using the gradient method, an increment is predefined.

13. A power plant, comprising:

a control device; and a control apparatus connected to the control device on a data input side, the control apparatus comprising:

a storage module;

a random generator module;

a gradient module; and a comparison module, wherein the random generator module and the gradient module are connected on a data output side to the comparison module, wherein the comparison module compares the output from the random generator module and the gradient module and sends a comparison to the storage module, and wherein the control apparatus is designed to perform a method for the installation control in a power plant, comprising:

generating a functional value of a target function based on a physical model for a plurality of sets of variables from respectively a set of environment variables and the respective set of variables, wherein the target function comprises a steeply ascending penalty function, wherein the penalty function has a quantitatively greater ascent than the target function;

optimizing an unmodified target function under active consideration of the penalty function, comparing the plurality of sets of variables and their respective functional values, allocating the functional value to the respective sets, and transmitting a selected set of variables from the storage module to the control device of the power plant wherein the allocated functional value complies with a predefined optimization criterion, wherein in addition to a starting set and a first set determined on the basis of the starting set and the functional value allocated thereto using a gradient method, a number of the plurality of sets of variables further comprises a second set selected by a random generator.

14. The power plant as claimed in claim 13, wherein the method is performed with cyclic repetition in a form of a loop, and wherein the selected set of variables of a first cycle is a starting set of a second cycle which follows the first cycle.

15. The power plant as claimed in claim 13, wherein the selected set of variables is forwarded from the control device to the respective control devices of the power plant allocated to the individual variables.

16. The power plant as claimed in claim 13, wherein before the determination in each case of the first set using the gradient method, an increment is predefined.

* * * * *